US007894302B2

(12) United States Patent
Aiello et al.

(10) Patent No.: US 7,894,302 B2
(45) Date of Patent: Feb. 22, 2011

(54) DRILLING SYSTEM COMPRISING A PLURALITY OF BOREHOLE TELEMETRY SYSTEMS

(75) Inventors: Robert Anthony Aiello, Spring, TX (US); Michael Louis Larronde, Houston, TX (US); John Martin, Houston, TX (US); Steven R. Farley, Magnolia, TX (US); Kirk Towns, Houston, TX (US)

(73) Assignee: Precision Energy Services, Inc., Fort Worth, TX (US)

( * ) Notice: Subject to any disclaimer, the term of this patent is extended or adjusted under 35 U.S.C. 154(b) by 1110 days.

(21) Appl. No.: 11/567,994

(22) Filed: Dec. 7, 2006

(65) Prior Publication Data

US 2008/0136665 A1 Jun. 12, 2008

(51) Int. Cl.
*E21B 47/18* (2006.01)

(52) U.S. Cl. ..... 367/83; 340/853.3; 340/854.6; 340/854.9; 340/855.3; 340/854.4

(58) Field of Classification Search ..... 340/853.3, 340/854.6, 854.9, 854.3, 855.3, 854.4; 367/82, 367/83

See application file for complete search history.

(56) References Cited

U.S. PATENT DOCUMENTS

| | | | | |
|---|---|---|---|---|
| 3,309,656 | A | 3/1967 | Godbey | |
| 3,713,089 | A | 1/1973 | Clacomb | |
| 3,958,217 | A | 5/1976 | Spinnler | |
| 4,216,536 | A | 8/1980 | More | |
| 4,302,757 | A | 11/1981 | Still | |
| 4,525,715 | A | 6/1985 | Smith | |
| 5,289,354 | A * | 2/1994 | Clayer et al. | 367/82 |
| 6,144,316 | A * | 11/2000 | Skinner | 340/853.7 |
| 6,958,707 | B1 | 10/2005 | Vinegar et al. | |
| 2003/0151977 | A1 * | 8/2003 | Shah et al. | 367/82 |

FOREIGN PATENT DOCUMENTS

GB 2428054 A1 1/2007

OTHER PUBLICATIONS

UK Search Report dated Jan. 7, 2008.
Canadian Intellectual Property Office, Office Action from Canadian Counterpart Appl. No. 2,601,323, dated Jul. 24, 2009, 2-pgs.

* cited by examiner

*Primary Examiner*—Albert K Wong
(74) *Attorney, Agent, or Firm*—Wong, Cabello, Lutsch, Rutherford & Brucculeri LLP

(57) ABSTRACT

A drilling system utilizing a plurality of independent telemetry systems. The drilling system uses a drill collar as a pressure housing for downhole components of the system. One or more sensors are disposed within the pressure housing. These sensors can be MWD sensors, LWD sensors, or both MWD and LWD sensors. A plurality of independent borehole telemetry systems is used to telemeter sensor response data to the surface of the earth. Each sensor cooperates with a downhole component of at least one of the independent telemetry systems. The plurality of telemetry systems can be of the same type, such as a mud pulse systems. Alternately, the telemetry systems can be of different types including a mud pulse system and an electromagnetic system.

33 Claims, 3 Drawing Sheets

DRILLING SYSTEM COMPRISING A PLURALITY OF BOREHOLE TELEMETRY SYSTEMS

CROSS-REFERENCE TO RELATED APPLICATIONS

This invention is directed toward measurements made within a borehole during the drilling of the borehole. More particularly, the invention is directed toward an measurement-while-drilling or a logging-while-drilling or a combination measurement-while-drilling and logging while drilling system comprising plurality of telemetry systems for communicating between a borehole assembly and the surface of the earth.

BACKGROUND OF THE INVENTION

It is often operationally and economically advantageous to obtain measurements of certain parameters of interest during the drilling of a well borehole. Systems for obtaining measurements relating to the drilling operation are commonly referred to as measurement-while-drilling or "MWD" systems. MWD systems typically yield measures of a plurality of borehole conditions, the orientation and path of the borehole assembly, and other drilling related parameters of interest. Systems for obtaining measurements of characteristics of formation material penetrated by the borehole are commonly referred to as logging-while-drilling or "LWD" systems. LWD systems typically yield measures of formation porosity, formation density, fluid saturation information, bedding information and the like.

Numerous types of telemetry systems are used to transfer data, while drilling, between a borehole assembly and surface equipment disposed at the surface of the earth. Mud pulse systems are known in the art. Basic principles of mud pulse telemetry systems are disclosed in U.S. Pat. No. 3,958,217 "Pilot Operated Mud-Pulse Valve" and U.S. Pat. No. 3,713,089 "Data Signaling Apparatus for Well Drilling Tools", both of which are herein entered into this disclosure by reference. U.S. Pat. No. 3,309,656 "Logging-While-Drilling System" discloses a mud pulse siren system, and is herein entered into this disclosure by reference. Electromagnetic telemetry systems are also known in the art. Basic principles of electromagnetic telemetry are disclosed in U.S. Pat. No. 4,525,715 "Toroidal Coupled Telemetry Apparatus" and U.S. Pat. No. 4,302,757 "Borehole Telemetry Channel of Increased Capacity", both of which are entered herein into this disclosure by reference. Within the context of this disclosure, the term "drilling system" includes both MWD and LWD systems.

Telemetry data transmission rates or telemetry bandwidths of LWD or MWD systems are relatively small in relation to comparable wireline systems. Although sensors disposed in borehole drilling assemblies may be as sophisticated as their wireline counterparts, real time measurements recorded at the surface of the earth are typically limited by LWD and MWD telemetry bandwidths. Redundant or parallel telemetry from a given sensor can increase telemetry bandwidth.

LWD and MWD telemetry systems are often "noisy" resulting from harsh conditions encountered in a borehole drilling environment. Again, redundant telemetry from a given sensor can optimize the flow of valid data between the sensor within the borehole assembly and the surface of the earth.

It is often desirable to make LWD and MWD measurements simultaneously while drilling. As an example, measurement of a formation parameter, such as formation resistivity, can be used as a criterion for controlling the direction in which the drill bit advances the borehole. This methodology is commonly referred to as "geosteering". The geosteering methodology requires simultaneous transmission of real-time MWD data from both a rotary steerable device and transmission of real-time data from at least one LWD sensor. The physical layout of a typical borehole assembly portion of a drilling system can introduce problems in telemetering both LWD and MWD data using a single telemetry system. As an example, a mud motor may segregate and electrically isolate the rotary steerable device and related sensors from a borehole assembly subsection comprising LWD sensors. Typically the rotary steerable device is disposed below the mud motor and the LWD sensor subsection is disposed above the mud motor. Any type of electrical connection through the mud motor is typically unreliable or logistically impractical. As a result, simultaneously transmit of both MWD and LWD data using this methodology with a single telemetry system is also typically unreliable or logistically impractical. Limited range or "short-hop" electromagnetic or acoustic transmission systems have been used to telemeter LWD data uphole past a mud motor to a single downhole telemetry unit for subsequent transmission to the surface. These systems typically have relatively narrow bandwidths, are unreliable in certain types of borehole environs, and add fabrication and maintenance costs to the borehole measure system.

SUMMARY OF THE INVENTION

The present invention is a drilling system comprising a plurality of independent telemetry systems. The drilling system comprises a borehole assembly typically comprising a drill collar, with the wall of the collar functioning as a pressure housing for various system components. One or more sensors are disposed within the borehole assembly. These sensors can be MWD sensors, LWD sensors, or both MWD and LWD sensors. The drilling system further comprises a plurality of independent borehole telemetry systems. Each sensor cooperates with a downhole component of at least one the independent telemetry systems. The plurality of telemetry systems can be of the same type, such as a mud pulse systems. Alternately, the telemetry systems can be of different types such as a mud pulse system and an electromagnetic system.

As mention previously, telemetry data transmission rates or telemetry bandwidths of LWD or MWD systems are relatively small in relation to comparable wireline systems. The invention can be embodied to increase data transmission rates to the surface of the earth. This is accomplished by operationally connecting in parallel two or more telemetry systems to a single sensor thereby obtaining redundant transmission and increasing the transmission bandwidth of the sensor.

The invention can also be embodied to increase reliability of LWD and MWD data telemetry. Once again, this is accomplished by operationally connecting two or more telemetry systems to a single sensor thereby providing redundant, parallel data transmission from the single sensor. If one transmission channel becomes noisy or fails, transmission to the surface is maintained through the parallel channel.

Embodied to employ geosteering techniques, the borehole assembly comprises one or more MWD and one or more LWD sensors. As discussed above, the physical configuration of the borehole assembly often segregates MWD and LWD sensors, and electrical connection of these sensors to a common downhole telemetry unit is typically unreliable and not operationally practical. A single telemetry system multiplexed to transmit both MWD and LWD data is, therefore, not desirable. Using capabilities of the present invention, LWD and MWD sensors cooperate with dedicated telemetry systems. Borehole components of the telemetry systems are disposed in close physical proximity to their assigned sensors. This negates telemetry problems introduced by the physical segregation of LWD and MWD sensors. It should also be understood that two or more telemetry systems can be dedicated to each MWD and LWD sensor thereby increasing data transmission rates and data transmission reliability as discussed in the previous paragraphs.

The plurality of telemetry systems must be configured to avoid communicating interference or "cross-talk". This can be achieved by employing at least two different types of telemetry systems, such as electromagnetic and mud pulse systems. Alternately, a plurality of the same type of telemetry system can be employed. In this embodiment of the invention, cross-talk is minimized by utilizing a different transmission "channel" for each telemetry system. As an example, two or more mud pulse telemetry systems can be operated concurrently by choosing the bandwidth of each system so as not to impede on the bandwidth of the other system. Simultaneous transmissions are discriminated as a function of telemetry channel by circuitry and cooperating processor elements preferably disposed at the surface of the earth. If two types of telemetry systems are used, an uphole telemetry unit receives transmissions from a downhole telemetry unit of corresponding type. If a plurality of telemetry systems of the same type is used, receptions by an uphole telemetry unit of corresponding type are filtered to delineate data transmitted in two or more data transmission channels using standard digital signal processing (DSP) techniques.

BRIEF DESCRIPTION OF THE DRAWINGS

So that the manner in which the above recited features, advantages and objects the present invention are obtained and can be understood in detail, more particular description of the invention, briefly summarized above, may be had by reference to the embodiments thereof which are illustrated in the appended drawings.

DETAILED DESCRIPTION OF THE PREFERRED EMBODIMENTS

Basic concepts of a drilling system comprising a plurality of independent telemetry systems will be illustrated using a system comprising a single MWD sensor, a single LWD sensor, and two telemetry systems.

Figure 1:
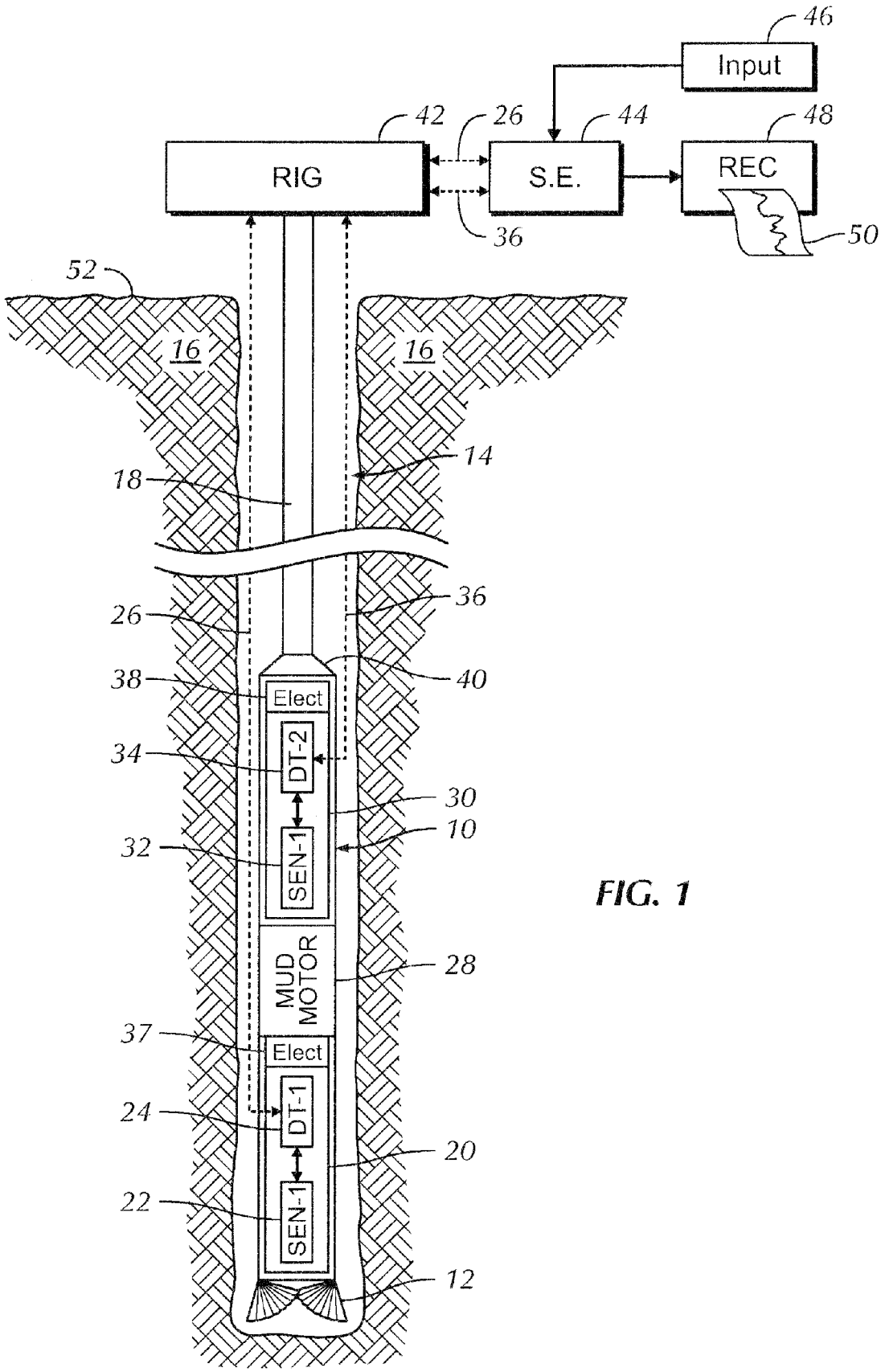
FIG. 1 illustrates the drilling system in a borehole environment.

FIG. 1 illustrates the drilling system in a borehole environment. A drill collar preferably functions as a pressure housing for a borehole assembly 10. The borehole assembly 10 terminates at a lower end with a drill bit 12. The borehole assembly 10 is shown suspended by means of a drill string 18 within a borehole 14 penetrating an earth formation 16. The upper end of the borehole assembly 10 is operationally connected to the lower end of a drill string 18 by a suitable connector 40. The upper end of the drill string is operationally attached to a rotary drilling rig that is well known in the art, and is illustrated conceptually at 42.

Again referring to FIG. 1, a MWD subsection 20 comprising directional drilling steering apparatus is disposed within the borehole assembly 10. In the illustrative example, only a single MWD sensor 22 is shown cooperating with a downhole telemetry unit 24 of a first telemetry system. The sensor 22 can be an inclinometer, an accelerometer, or any type of sensor used to provide drilling related information. The MWD subsection 20 can comprise a plurality of sensors and a plurality of downhole telemetry units, although only a single sensor and single cooperating downhole telemetry unit are shown for purposes of illustration. A LWD subsection 30 is also shown disposed within the borehole assembly 10. Within the LWD subsection 30, only a single LWD sensor 32 is shown cooperating with a downhole telemetry unit 34 of a second telemetry system. The LWD sensor 32 can be responsive to formation resistivity, formation density, formation porosity, formation fluid saturation and the like. As with the MWD subsection 20, the LWD subsection 30 can comprise a plurality of sensors and a plurality of downhole telemetry units, although only a single LWD sensor 32 and single cooperating downhole telemetry unit 34 are shown for purposes of illustration.

Still referring to FIG. 1, a mud motor 28 is shown disposed between the MWD subsection 20 and the LWD subsection 30. The disposition of the mud motor 28 renders impractical any direct electrical connection between the MWD subsection 20 and the LWD subsection 30. As discussed previously, any such direct electrical connection between the MWD subsection 20 and the LWD subsection 30 and through the mud motor 28 is typically unreliable or logistically impractical. This, in turn, renders the use of a single telemetry system unreliable or logistically impractical as a means of transmitting data from both the MWD sensor 22 and the LWD sensor 34. Stated another way, the MWD subsection 20 is electrically isolated, in a direct connection sense, from the LWD subsection 30. Furthermore, the segregating mud motor 28 renders desirable the use of two electronics subsections 37 and 36 to provide power and control circuitry for the MWD subsection 20 and LWD subsection 30, respectively.

Data transmissions to the surface 52 of the earth from downhole telemetry units 24 and 34 are illustrated conceptually with broken line 26 and 36, respectively, shown in FIG. 1. These transmissions are received by surface equipment 44 disposed at the surface of the earth 52, and converted into parameters of interest as will be described in subsequent sections of this disclosure. The parameters of interest are optionally stored within a recording device 48. The parameters of interest are typically tabulated as a function of borehole depth at which they are measured thereby forming a "log" 50 of these parameters. Information, such as directional drilling data or LWD sensor calibration data, can be transmitted from the surface 52 of the earth to the MWD subsection 20 or LWD subsection 30. This "down link" data is preferably input into the surface equipment 44 through an input device 46.

As discussed previously, the telemetry units can be of the same type, such as mud pulse systems, or of different types such as a mud pulse system and an electromagnetic system. Furthermore, multiple sensors can be modulated and transmit over a single telemetry system. The following sections disclose in more detail these embodiments.

Figure 2:
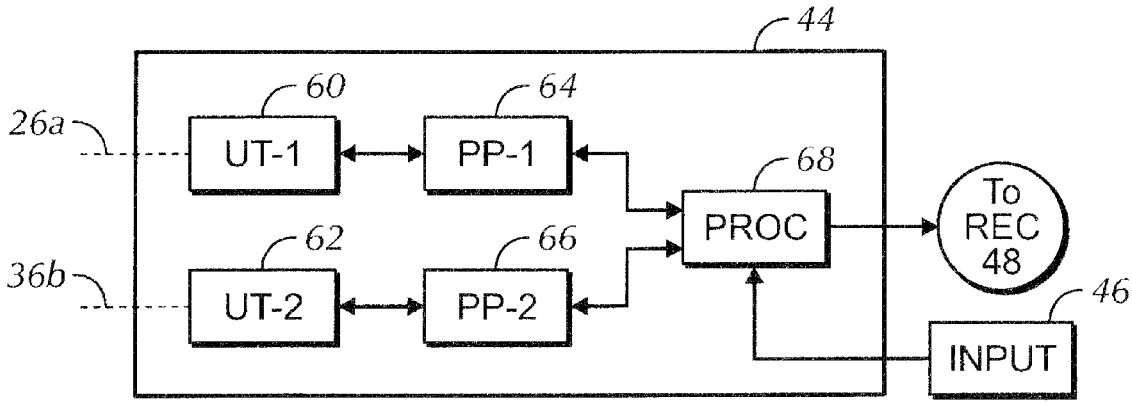
FIG. 2 is an illustration of the surface equipment embodied to receive data from two different types of telemetry systems.

FIG. 2 is an illustration of the surface equipment 44 embodied to receive data from two different types of telemetry systems, such as a mud pulse system and an electromagnetic system. The broken line 26*a* illustrates conceptually data transmission from a downhole telemetry unit of a first type (such as a mud pulse system). This transmission is received by a compatible uphole telemetry unit 60 of the same type. The broken line 36*a* illustrates conceptually data transmission from a downhole telemetry unit of a second type (such as an electromagnetic system). This transmission is received by a compatible uphole telemetry unit 62 of the same type. Outputs of uphole telemetry units 60 and 62 are optionally input into preprocessor units 64 and 66, respectively. These preprocessor units convert signals from different types of telemetry systems (e.g. mud pulse and electromagnetic) into a format that can be input into a processor 68. Data transmitted from the downhole sensors are converted into parameters of interest within the processor 64 using predetermined mathematical relations. The parameters of interest are subsequently output to a suitable recorder 48 for real time use and for permanent storage. Down link data to be transmitted from the surface to the borehole assembly 100 are preferably input from an input device 46 and into the processor 68. The processor then passes the down link data through the preprocessors 64 and 66 as required, and to the appropriate uphole telemetry unit 60 or 62 for transmission to the corresponding downhole telemetry unit 26 or 36 (see FIG. 1).

Still referring to FIG. 2, it is again noted that only two types of telemetry systems are shown to illustrate the concepts of the invention. Three or more types can be employed using appropriate pairs of downhole and uphole telemetry units. Transmissions from the same sensor through differing types of downhole telemetry units can be received by the uphole telemetry units 60 and 62. This embodiment has been discussed previously and serves two purposes. The first purpose is to increase data transmission rates from the sensor to the surface of the earth. This is accomplished by operationally connecting in parallel two or more telemetry systems of differing types to the single sensor thereby increasing the transmission bandwidth of the sensor. The second purpose is to increase reliability of sensor telemetry by providing redundant data transmission should one telemetry system becomes noisy or fails.

Figure 3:
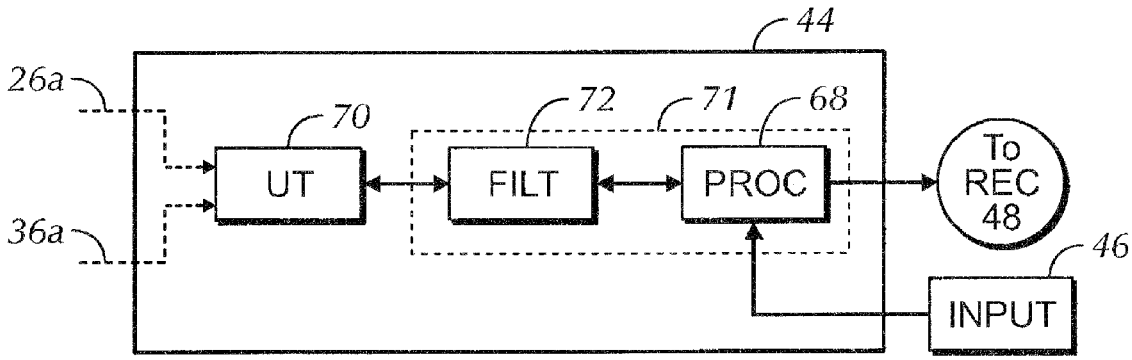
FIG. 3 is an illustration of the surface equipment embodied to receive data from telemetry systems of the same type.

FIG. 3 is an illustration of the surface equipment 44 embodied to receive data from telemetry systems of the same type, such as a mud pulse system or a mud pulse siren system or an electromagnetic system. The broken line 26*a* again illustrates conceptually data transmission from one or more downhole telemetry units. If the data transmission comprises contributions from more than one sensor and cooperating downhole telemetry unit, all downhole telemetry units are of the same type. (such as a mud pulse system). The multiple transmissions must, therefore, be multiplexed so that one sensor response can be discriminated from another. The transmission, whether from a single sensor or multiplexed from a plurality of sensors, is received by a compatible uphole telemetry unit 70. For purposes of discussion, it will be assumed that the transmission is multiplexed. This multiplexed signal is passed to a filter circuit 72 wherein the composite multiplexed signal is decomposed into components. Each component represents a transmitted response from a single sensor. Decomposition can be accomplished by a variety of DSP techniques including semblance or least squares fitting. Decomposed signal responses are then input to a processor 68 wherein they are converted into parameters of interest. Optionally, the decomposition of the composite signal can be performed within the processor, as illustrated conceptually by the broken line box 71 encompassing both the filter circuit 72 and the processor 68. As an example, a first decomposed signal may represent the response of a MWD sensor indicative of the position of the borehole assembly 100, and a second decomposed signal may represent a LWD formation parameter of interest such as resistivity. Within the processor 68, position and resistivity are quantified from the respective sensor responses, and optionally combined to create a geosteering signal used to direct the direction of the borehole drilling operation. The geosteering signal may, in turn, be telemetered as a down link command to the MWD subsection to obtain the desired adjustment in drilling direction. As in the previously discussed embodiment shown in FIG. 2, parameters of interest can also be output to the recorder 48 for real time use and for permanent storage. Additional down link data can be transmitted from the surface to the borehole assembly 100 via the input device 46 cooperating with the processor 68 and the uphole telemetry unit 70.

Figure 4:
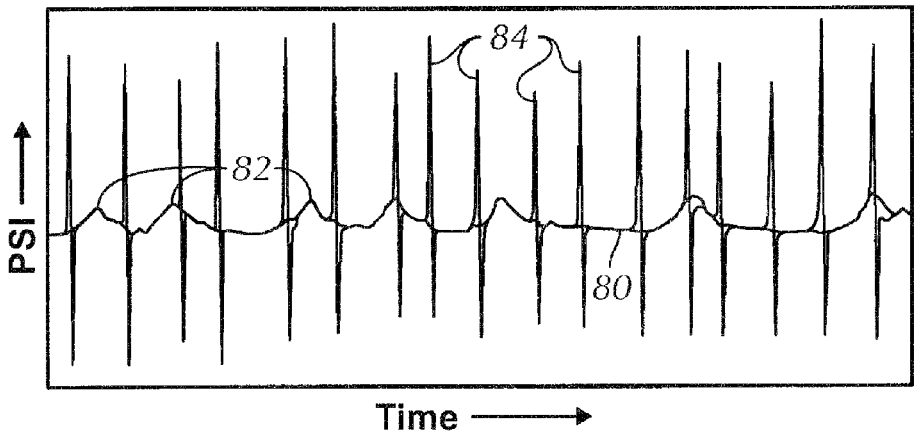
FIG. 4 is an illustration of a multiplexed transmission sensed by an uphole mud pulse telemetry unit.

FIG. 4 is an illustration of a multiplexed transmission sensed by an uphole mud pulse telemetry unit. The curve 80 is a plot of pressure as a function of time. The higher amplitude higher frequency peaks 84 represent data transmission from a first sensor. The lower amplitude lower frequency peaks 82 represent data transmission from a second sensor. Referring to FIG. 3 as well as FIG. 4, the composite signal 80 is received by the uphole telemetry unit 70, input into the filter circuit 72 wherein the low amplitude and low frequency component is separated from the high amplitude and high frequency component. These components, which represent sensor responses, are then transformed into the above discussed parameters of interest within the processor 68.

Figure 5:
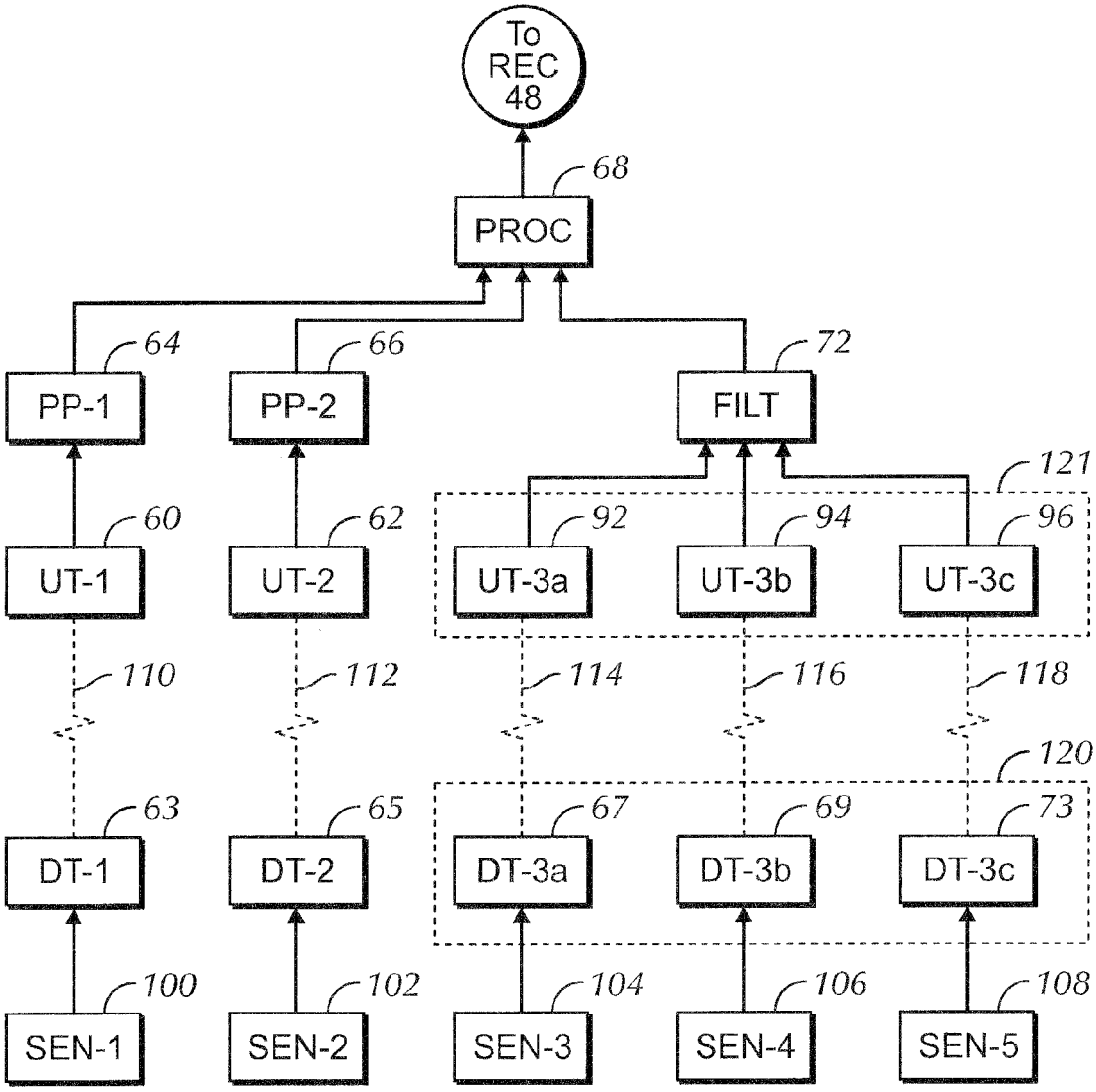
FIG. 5 is a functional diagram of a system comprising five sensors and two different types of telemetry systems.

FIG. 5 is a functional diagram of a system embodiment with five sensors and two different types of telemetry systems. For purposes of discussion, assume that sensors 100 and 102 are MWD and LWD sensors, respectively. Sensors 100 cooperate with downhole telemetry units 63 and 65, respectively. These sensors are shown cooperating with telemetry systems of different types. Again for purposes of discussion, assume that sensor 100 is cooperating with a mud pulse telemetry system and sensor 102 is cooperating with an electromagnetic telemetry system. Downhole telemetry units 63 and 65 cooperate with corresponding uphole telemetry units 60 and 62, as illustrated conceptually with the broken lines 110 and 112, respectively. Uphole signal processing, using preprocessor units 64 and 66 and the processor 68, has been discussed and illustrated previously (see FIG. 2 and related discussion). MWD and LWD parameters of interest, determined from the responses of sensors 100 and 102, are then output to the recording and storage device 48.

Still referring to FIG. 5, three additional sensors 104, 106 and 106 are illustrated cooperating with a single telemetry system. The types of sensors 104, 106 and 108 can be MWD, LWD or combinations of MWD and LWD. Alternately, all three sensors can respond to the same physical parameter thereby increasing transmission bandwidth as discussed previously. For purposes of discussion, assume that the telemetry system is a mud pulsed system as illustrated using two sensors in FIG. 4.

The system can be embodied to comprises three separate or "dedicated" downhole telemetry units 67, 69 and 73 cooperating with the sensors 104, 106 and 108, respectively. These dedicated downhole telemetry units can be embodied to cooperate with three corresponding and likewise "dedicated" uphole telemetry units 92, 94 and 96, as illustrated conceptually by the broken lines 114, 116 and 118, respectively. If embodied in this fashion, the filter circuit 72 serves only to sort the input signals from uphole telemetry units 92, 94 and 96 since no multiplexed composite signal is transmitted from the corresponding dedicated downhole telemetry units. Each transmission is indicative of a single sensor response. Parameters of interest are computed from the sensor response in the processor 68, and recorded and stored by the appropriate recorder 48.

If multiplexing is employed, the sensors 104, 106 and 108 shown in FIG. 5 cooperate with a single downhole telemetry unit, as illustrated conceptually by the box 120. A single multiplexed signal (not illustrated) is telemetered as a composite signal to a single uphole telemetry unit, illustrated conceptually with the box 121. Output from the single uphole telemetry 121 unit is then decomposed using the filter unit 72, as illustrated in FIG. 3 and described with the accompanying discussion. Decomposed signals representative of responses of sensors 104, 106 and 106 are then converted by the processor 68 into parameters of interest, and recorded and stored in an appropriate recorder unit 48

While the foregoing disclosure is directed toward the preferred embodiments of the invention, the scope of the invention is defined by the claims, which follow.

What is claimed is:

1. A measurement system, comprising:

a borehole assembly comprising a MWD sensor disposed within a MWD subsection, a LWD sensor disposed within a LWD subsection, a mud motor axially disposed between said MWD subsection and said LWD subsection, a first downhole telemetry unit disposed in said MWD subsection and cooperating with said MWD sensor, and a second downhole telemetry unit disposed in said LWD subsection and cooperating with said LWD sensor; and surface equipment comprising a first uphole telemetry unit cooperating with said first downhole telemetry unit, a second uphole telemetry unit cooperating with said second downhole telemetry unit; and a processor cooperating with said first uphole telemetry unit and said second uphole telemetry unit to convert responses of said LWD sensor and said MWD sensor into parameters of interest.

2. The system of claim 1, wherein said MWD or LWD sensor comprises:

at least one first sensor cooperating with said first downhole telemetry system; and at least one second sensor cooperating with said second downhole telemetry unit.

3. The system of claim 2, wherein said processor cooperates with said first uphole telemetry unit and with said second uphole telemetry unit to convert redundant response signals from said first and second sensors into the parameter of interest.

4. The system of claim 1, wherein said first downhole and uphole telemetry units comprise a first type of telemetry system, and wherein the said second downhole and uphole telemetry units comprise a second type of telemetry system.

5. The system of claim 1, wherein said first downhole telemetry unit is electrically isolated from said second downhole telemetry unit.

6. The system of claim 1, further comprising:

a plurality of said MWD sensors cooperating with said first downhole telemetry unit; and a first filter circuit cooperating with said first uphole telemetry unit to decompose into components a composite signal telemetered between said first downhole and uphole telemetry units, wherein the processor cooperates with said first filter circuit to convert said components into a parameter representative of responses of each of said MWD sensors.

7. The system of claim 6, further comprising:

a plurality of said LWD sensors cooperating with said second downhole telemetry unit; and a second filter circuit cooperating with said second uphole telemetry unit to decompose into components a composite signal telemetered between said second downhole and uphole telemetry units, wherein the processor cooperates with said second filter circuit to convert said components into a parameter representative of responses of each of said LWD sensors.

8. The system of claim 1, wherein said first and second telemetry systems are of the same type.

9. The system of claim 4, wherein said processor is configured to discriminate redundant data transmission of the response signals from said MWD and LWD sensors received by said first and second uphole telemetry units.

10. The system of claim 8, wherein said first telemetry system uses a first transmission channel, wherein said second telemetry system uses a second transmission channel with a second bandwidth chosen not to impede with a first bandwidth of said first telemetry system, and wherein said processor is configured to use said first and second transmission channels to discriminate parallel data transmissions of the response signals from said at least one first sensor received by said first and second uphole telemetry units.

11. The system of claim 1, further comprising:

a plurality of said LWD sensors cooperating with said second downhole telemetry unit; and a second filter circuit cooperating with said second uphole telemetry unit to decompose into components a composite signal telemetered between said second downhole and uphole telemetry units, wherein the processor cooperates with said second filter circuit to convert said components into a parameter representative of responses of each of said LWD sensors.

12. A method for telemetering response data from at least one sensor disposed within a borehole, the method comprising:

providing a borehole assembly having a measurement-while-drilling (MWD) subsection and a logging-while-drilling (LWD) subsection;

providing a first telemetry system by disposing a first downhole telemetry unit within said MWD subsection of said borehole assembly, and disposing at the surface of the earth a first uphole telemetry unit that cooperates with said first downhole telemetry unit;

providing a second telemetry system by disposing a second downhole telemetry unit within said LWD subsection of said borehole assembly, and disposing at said surface of the earth a second uphole unit telemetry unit that cooperates with said second downhole telemetry unit;

disposing an MWD sensor within the MWD subsection to cooperate with said first downhole telemetry unit;

disposing an LWD sensor within the LWD subsection to cooperate with said second downhole telemetry unit;

disposing a mud motor axially between said MWD and LWD subsections; and cooperating a processor with said first and second uphole telemetry units to convert response signals from said LWD and MWD sensors into parameters of interest.

13. The method of claim 12, wherein said first telemetry system is a first type and said second telemetry system is a second type.

14. The method of claim 12, comprising the additional step of electrically isolating said first downhole telemetry unit from said second downhole telemetry unit.

15. The method of claim 12, wherein disposing said MWD or LWD sensor within said borehole assembly comprises operationally connecting at least one first sensor to said first downhole telemetry system and operationally connecting at least one second sensor to said second downhole telemetry unit.

16. The method of claim 12, wherein disposing said MWD sensor within said borehole assembly comprises disposing a plurality of said MWD sensors that cooperate with said first downhole telemetry unit; and wherein the method further comprises:

decomposing into components a composite signal telemetered between said first downhole telemetry unit and said first uphole telemetry unit; and converting with said processor each said component into a parameter representative of responses of each of said MWD sensors.

17. The method of claim 15, further comprising the steps of: converting with said processor redundant response signals received by said first uphole telemetry unit and by said second uphole telemetry unit into the parameter of interest.

18. The method of claim 12, wherein disposing said at least one LWD sensor within said borehole assembly comprises disposing within said borehole assembly a plurality of said first LWD sensors cooperating with said second downhole telemetry system; and wherein the method further comprises:

decomposing into components a composite signal telemetered between said second downhole telemetry unit and said second uphole telemetry unit; and converting with said processor each said component into a parameter representative of responses of each of said LWD sensors.

19. The system of claim 13, further comprising discriminating redundant data transmission of the response signals from said MWD and LWD sensors received by said first and second uphole telemetry units.

20. The system of claim 12, wherein said first and second telemetry systems are of the same type.

21. The system of claim 20, further comprising:

using a first transmission channel for said first telemetry system and a second transmission channel for said second telemetry system, the second transmission channel having a second bandwidth chosen not to impede with a first bandwidth of said first telemetry system; and using said first and second transmission channels to discriminate parallel data transmissions of the response signals from said MWD and LWD sensors received by said first and second uphole telemetry units.

22. A measurement system, comprising:

at least one first sensor disposed within a first subsection of a borehole assembly, wherein said at least one first sensor comprises at least one measurement-while-drilling (MWD) sensor;

a first downhole telemetry unit disposed in said first subsection and cooperating with said at least one first sensor;

at least one second sensor disposed within a second subsection of said borehole assembly, wherein said at least one second sensor comprises at least one logging-while-drilling (LWD) sensor;

a second downhole telemetry unit disposed in said second subsection and cooperating with said at least one second sensor;

a mud motor axially disposed between said first and second subsections;

a first uphole telemetry unit cooperating with said first downhole telemetry unit;

a second uphole telemetry unit cooperating with said second downhole telemetry unit; and a processor cooperating with said first and second uphole telemetry units to convert responses of said at least one first and second sensors into parameters of interest.

23. The system of claim 22, wherein said first downhole and uphole telemetry units comprise a first type of telemetry system, and wherein the said second downhole and uphole telemetry units comprise a second type of telemetry system.

24. The system of claim 22, wherein said first downhole telemetry unit is electrically isolated from said second downhole telemetry unit.

25. The system of claim 22, further comprising:

a plurality of said at least one first sensors cooperating with said first downhole telemetry unit; and a first filter circuit cooperating with said first uphole telemetry unit to decompose into components a composite signal telemetered between said first downhole telemetry unit and said first uphole telemetry unit, wherein the processor cooperates with said first filter circuit to convert said components into a parameter representative of responses of each of said first sensors.

26. The system of claim 25, further comprising:

a plurality of said at least one second sensors cooperating with said second downhole telemetry unit; and a second filter circuit cooperating with said second uphole telemetry unit to decompose into components a composite signal telemetered between said second downhole telemetry unit and said second uphole telemetry unit, wherein the processor cooperates with said second filter circuit to convert said components into a parameter representative of responses of each of said second sensors.

27. The system of claim 22, wherein said first and second telemetry systems are of the same type.

28. The system of claim 27, wherein said first telemetry system uses a first transmission channel, wherein said second telemetry system uses a second transmission channel with a second bandwidth chosen not to impede with a first bandwidth of said first telemetry system, and wherein said processor is configured to use said first and second transmission channels to discriminate parallel data transmissions of the response signals from said at least one first sensor received by said first and second uphole telemetry units.

29. The method of claim 16, wherein disposing said at least one LWD sensor within said borehole assembly comprises disposing within said borehole assembly a plurality of said LWD sensors cooperating with said second downhole telemetry system; and wherein the method further comprises:

decomposing into components a composite signal telemetered between said second downhole telemetry unit and said second uphole telemetry unit; and converting with said processor each said component into a parameter representative of responses of each of said LWD sensors.

30. The system of claim 22, further comprising:

a plurality of said at least one second sensors cooperating with said second downhole telemetry unit; and a second filter circuit cooperating with said second uphole telemetry unit to decompose into components a composite signal telemetered between said second downhole telemetry unit and said second uphole telemetry unit, wherein the processor cooperates with said second filter circuit to convert said components into a parameter representative of responses of each of said second sensors.

31. The system of claim 23, wherein said processor is configured to discriminate redundant data transmission of the response signals from said at least MWD and LWD sensors received by said first and second uphole telemetry units.

32. The system of claim 22, wherein said MWD or LWD sensor comprises:

at least one first sensor cooperating with said first downhole telemetry system; and at least one second sensor cooperating with said second downhole telemetry unit.

33. The system of claim 32, wherein said processor cooperates with said first uphole telemetry unit and with said second uphole telemetry unit to convert redundant response signals from said first and second sensors into the parameter of interest.

* * * * *